US010413101B2

(12) United States Patent
Porco

(10) Patent No.: US 10,413,101 B2
(45) Date of Patent: Sep. 17, 2019

(54) ATTACHABLE PLATE AND CUP ASSEMBLY

(71) Applicant: Christopher Aldo Porco, Lansing, MI (US)

(72) Inventor: Christopher Aldo Porco, Lansing, MI (US)

( * ) Notice: Subject to any disclaimer, the term of this patent is extended or adjusted under 35 U.S.C. 154(b) by 116 days.

(21) Appl. No.: 15/384,252

(22) Filed: Dec. 19, 2016

(65) Prior Publication Data

US 2018/0168374 A1 Jun. 21, 2018

(51) Int. Cl.
*A47G 19/02* (2006.01)
*A47G 19/06* (2006.01)

(52) U.S. Cl.
CPC ..... *A47G 19/065* (2013.01); *A47G 19/06* (2013.01)

(58) Field of Classification Search
CPC ..... A47G 19/06; A47G 19/065
See application file for complete search history.

(56) References Cited

U.S. PATENT DOCUMENTS 5,058,737 A 10/1991 Patterson et al.
5,078,737 A 1/1992 Bona et al.
5,240,136 A 8/1993 Patterson et al.
5,292,028 A 3/1994 Patterson et al.
5,954,195 A 9/1999 Krueger et al.
8,444,001 B1 5/2013 Dawson
9,221,376 B2 12/2015 Baker
2007/0264167 A1 11/2007 Warner
2008/0142528 A1 6/2008 Lim
2008/0257895 A1 10/2008 Broselow
2016/0120342 A1* 5/2016 Petersburg ..... A47G 19/065 220/574

* cited by examiner

*Primary Examiner* — Jeffrey R Allen
*Assistant Examiner* — Jennifer Castriotta
(74) *Attorney, Agent, or Firm* — WSU Patent Procurement Clinic

(57) ABSTRACT

An attachable plate and cup assembly that allows the user to hold both a plate and a cup in one hand. The assembly includes a cup having an open top portion and a closed bottom portion, and the open top portion has at least two substantially parallel sides. The assembly also includes a plate having a top surface and a bottom surface. A cup receiving structure protrudes downward from the bottom surface, and has at least two substantially parallel sides. Each of the substantially parallel sides has an inwardly facing channel to accommodate a lip of the cup.

11 Claims, 4 Drawing Sheets

ATTACHABLE PLATE AND CUP ASSEMBLY

BACKGROUND

The present invention relates generally to tableware used in a variety of social settings. More specifically, the invention relates to a plate and cup that can assemble together.

Often at social gatherings, such as tailgates or picnics, food items and beverages are served on disposable tableware. A particular guest at such a gathering, who desires both food and beverage, must hold a plate in one hand and a cup in the other until adequate seating becomes available, if at all. In many such situations, guests unsurprisingly have to consume food or beverages while standing up, without a table or other convenient place to set their tableware down nearby. The guest is then left to manage the plate with one hand while using the other to both hold the cup and try to eat at the same time. As a result of this awkward arrangement, spills are more likely to occur. Additionally, since both hands are occupied with the use of these conventional plates and cups, it also makes it difficult for a guest to greet others, let alone hold an eating utensil, napkin, or any additional items. For the foregoing reasons, there is a need for an improved plate and cup assembly that allows the individual to maintain a free hand for which to eat or drink.

SUMMARY

The present invention, solving the problems as identified in the Background, includes an attachable plate and cup assembly. In an exemplary embodiment of the present invention, the assembly includes a cup having an open top portion and a closed bottom portion. The open top portion has two substantially parallel linear edges. The assembly also includes a plate having a top surface and a bottom surface. A cup receiving structure protrudes downward from the bottom surface. The cup receiving structure has at least two substantially parallel sides. Each side includes an inwardly facing channel to accommodate the lip of a cup.

In another embodiment according to any of the previous embodiments, the cup is configured to slide into the cup receiving structure from one side. The substantially parallel linear edges of the cup engage with the substantially parallel sides of the cup receiving structure.

In another embodiment according to any of the previous embodiments, the cup receiving structure has a third side substantially perpendicular to the parallel sides.

In another embodiment according to any of the previous embodiments, the cup receiving structure protrudes perpendicular from the bottom surface of the plate.

In another embodiment according to any of the previous embodiments, the cup receiving structure includes an opening configured to receive the cup.

In another embodiment according to any of the previous embodiments, the cup receiving structure includes a gripper on one of the substantially parallel sides or the third side.

In another embodiment according to any of the previous embodiments, the gripper is an aperture that provides access to the cup through the cup receiving structure.

In another embodiment according to any of the previous embodiments, the cup includes a rounded edge connecting two of the substantially parallel edges.

In another embodiment according to any of the previous embodiments, each of the substantially parallel sides are the same length.

In another embodiment according to any of the previous embodiments, the top surface of the plate is indented about a perimeter for stacking of multiple plates.

In another featured embodiment of the present invention, a plate has a bottom surface and a unitary cup receiving structure extending from the bottom surface. The structure has at least two substantially parallel sides and a third side perpendicular to the parallel sides forming a U-shape, and an opening on a fourth side.

In another embodiment according to any of the previous embodiments, the cup receiving structure has an inwardly facing channel about a bottom edge of the substantially parallel sides.

In another embodiment according to any of the previous embodiments, the opening is configured to receive a cup.

In another embodiment according to any of the previous embodiments, the cup receiving structure is integrally molded with the bottom surface.

In another embodiment according to any of the previous embodiments, the plate includes a gripper on one of the substantially parallel sides or the third side.

In another embodiment according to any of the previous embodiments, the gripper is an aperture.

In another featured embodiment of the present invention, a beverage cup includes a perimeter defining an open top portion of the cup. The perimeter has a first edge and a second edge substantially parallel with one another, and third edge perpendicular to the first and second edges. A lip extends outward relative to a central axis of the cup at the open top portion.

In another embodiment according to any of the previous embodiments, the perimeter of the open top portion includes a rounded fourth edge connecting the first edge and the second edge.

In another embodiment according to any of the previous embodiments, the third edge is rounded.

In another embodiment according to any of the previous embodiments, the cup is plastic.

The various features and advantages of this invention will become apparent to those skilled in the art from the following detailed description of an embodiment, appended claims, and accompanying drawings. The drawings that accompany the detailed description can be briefly described as follows.

DETAILED DESCRIPTION

Figure 1:
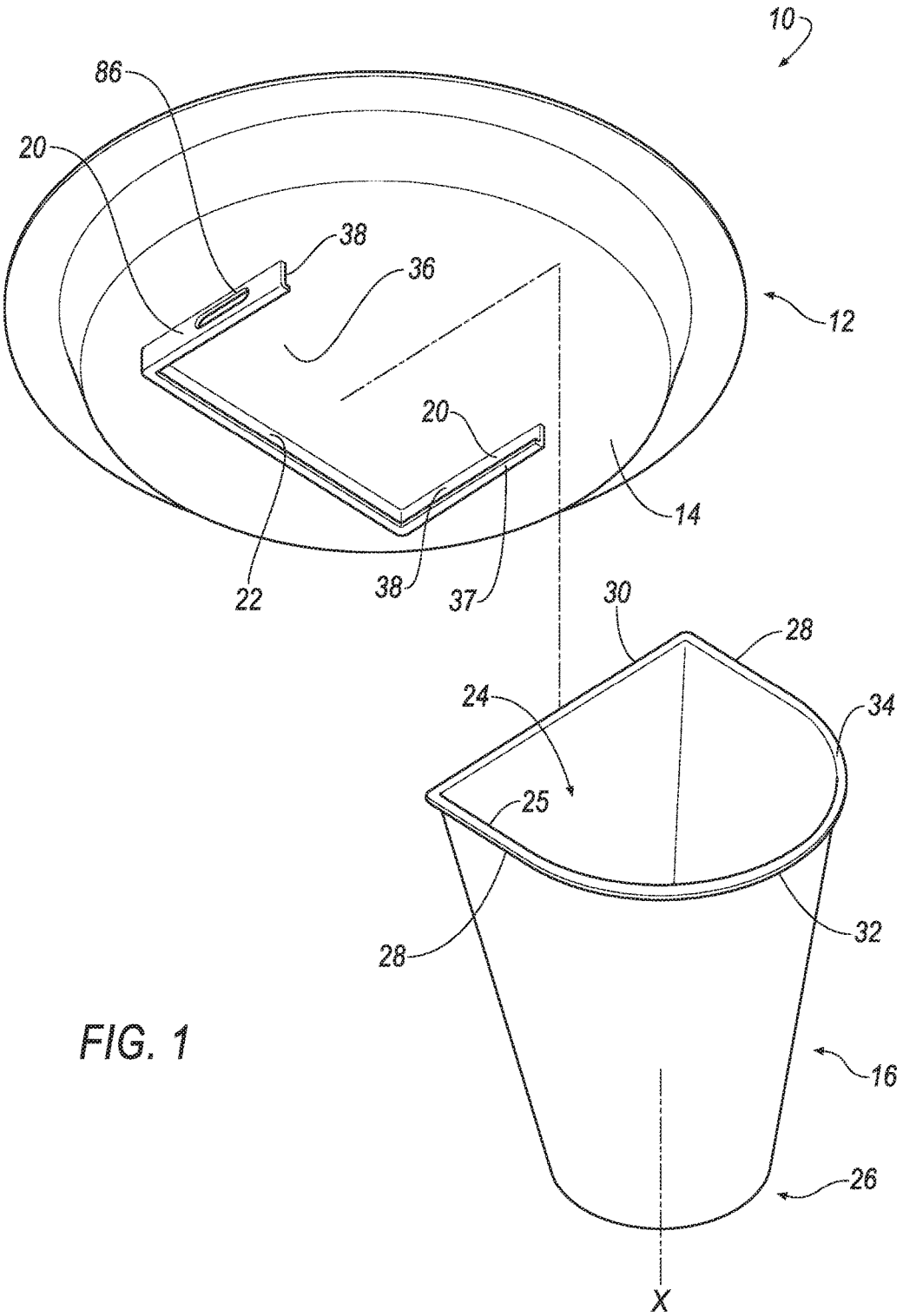
FIG. 1 is an exploded view of the plate and cup assembly.
Figure 2:
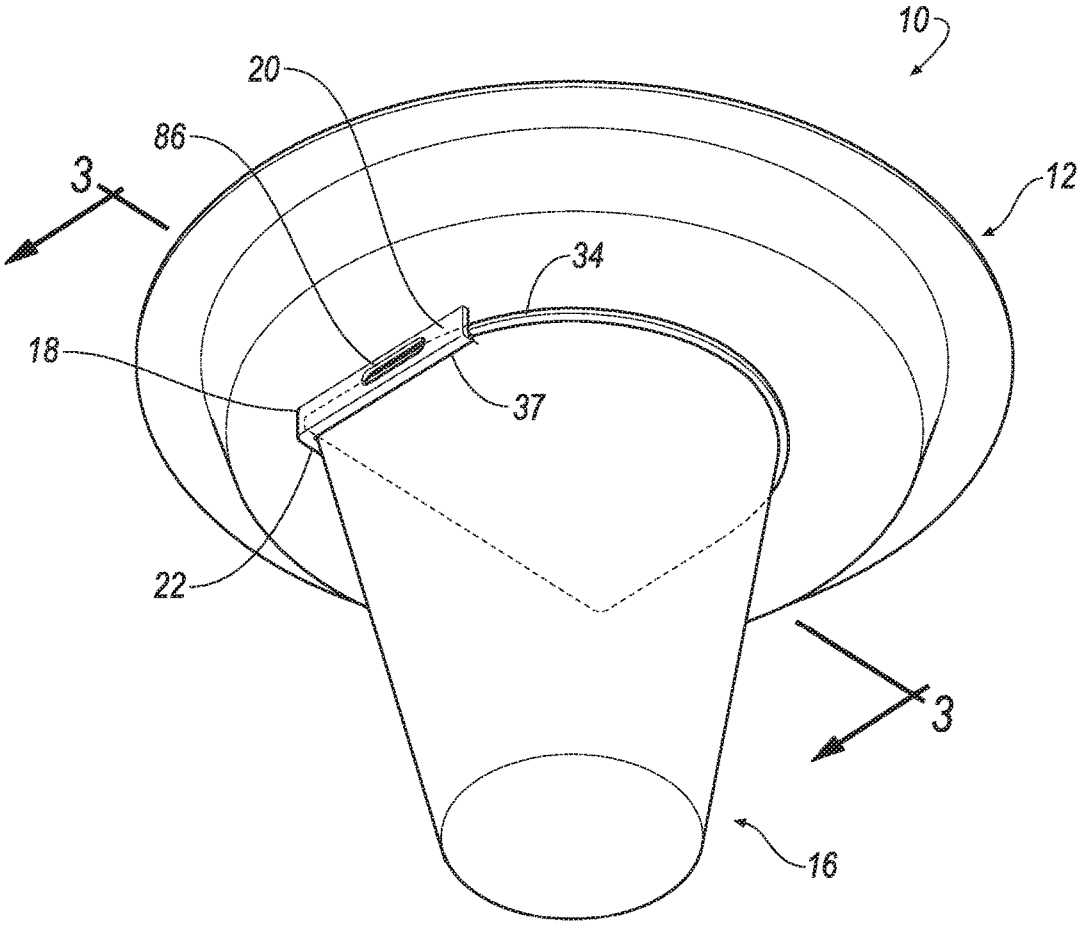
FIG. 2 is an isometric view of the plate and cup assembly of FIG. 1.
Figure 3:
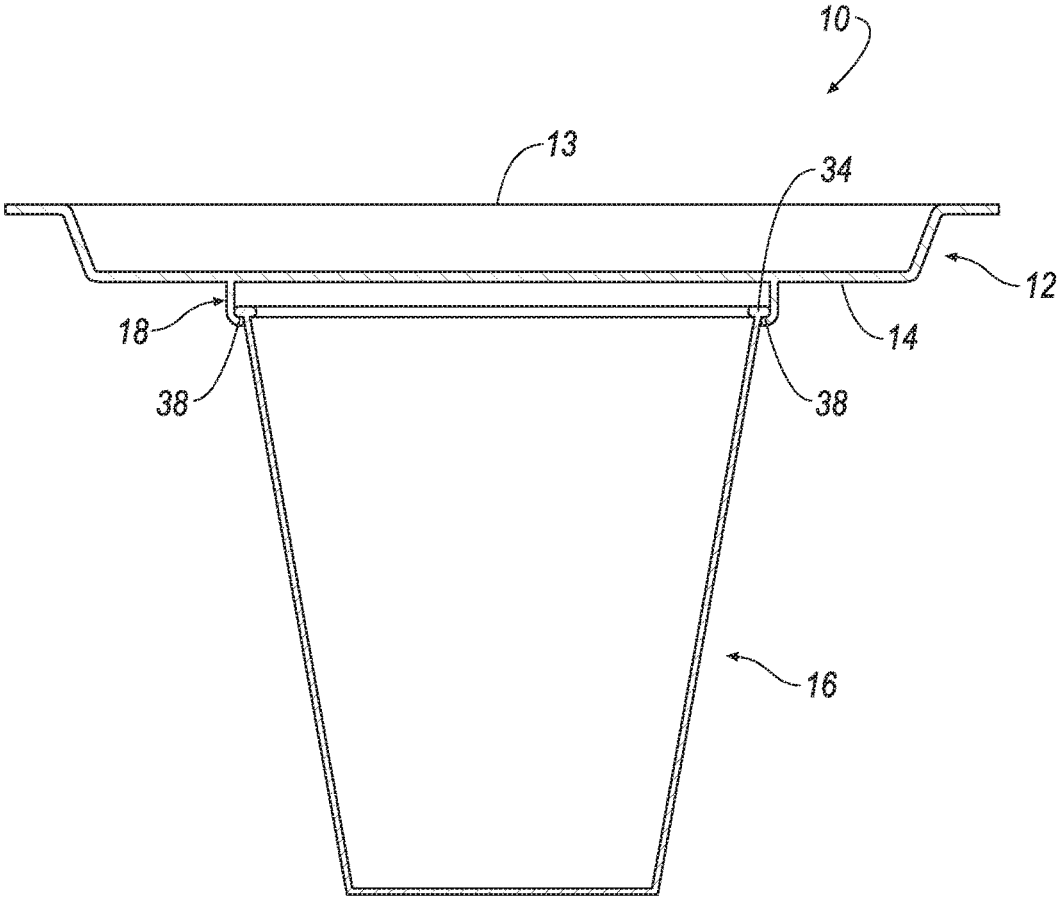
FIG. 3 is a cross sectional view of the plate and cup assembly of FIG. 1.

Referring more specifically to the drawings, FIG. 1 illustrates an exploded view of a plate and cup assembly 10 according to an exemplary embodiment of the present invention. The assembly 10 includes a plate 12 and a cup 16. The plate 12 includes a top surface 13 (shown in FIG. 3) for food storage and a bottom surface 14 having an integrally molded cup receiving structure 18 extending therefrom or defined therein. The cup receiving structure 18 receives a beverage cup 16 as shown in FIGS. 1-3. When in an upright position, an individual may carry the beverage cup 16 and plate 12 with one hand.

It should be understood that the plate 12 and beverage cup 16 may be manufactured out of a variety of suitable materials for tableware including, but not limited to, plastic, paper, wood, metal or the like. In an embodiment, the plate 12 and cup 16 are made from the same material. In an embodiment, the top surface 13 of the plate 12 is indented to allow for stacking of multiple plates 12. The cups 16 may also be configured to allow for stacking of multiple cups 16.

As shown in FIG. 1, the cup receiving structure 18 protrudes downward from the bottom surface 14 of the plate 12, when the cup and plate assembly 10 are in an upright position. In an embodiment, the cup receiving structure 18 extends substantially perpendicular from the bottom surface 14 of the plate 12. The cup receiving structure 18 is shown in a U-shape, having at least two substantially parallel sides 20 and a third side 22 perpendicular to the substantially parallel sides. In an embodiment, the two substantially parallel sides 20 are linear and of the same length. Although the third side is presented in a linear fashion, it is understood that this is for exemplary purposes only and is not limited thereto. For instance, the third side could have a shape suitable to the shape of the cup that it is designed to receive. Furthermore, it is understood that the inner length of the cup receiving structure is sized to accommodate the size of the beverage cup it is designed to receive.

As best shown in FIG. 1, the beverage cup 16 has an open top portion 24 and a closed bottom portion 26. The perimeter 25 of the open top portion 24 of the beverage cup 16 is designed as to correspond with the shape of the cup receiving structure 18, and therefore includes two substantially parallel edges 28, and a third edge 30 perpendicular to the substantially parallel edges. The two substantially parallel edges 28 may both include linear portions that are parallel to one another, as opposed to a lip that is entirely circular or curved with no linear or parallel edges. Although the third edge is presented in a linear fashion, it should be noted that the invention is not so limited. For example, the third edge 30 of a cup could embody a rounded shape corresponding to rounded third side of a cup receiving structure.

The cup 16 includes a fourth edge 32, opposite the third edge 30, connecting two of the substantially parallel edges 28. In the illustrated embodiment, the fourth edge 32 is a rounded edge. This rounded edge is designed accordingly so as to mimic the traditional look and feel of a conventional beverage cup. Furthermore, the cup 16 includes a lip 34 extending outward relative to a central axis X of the cup about at least a portion of the perimeter 25 at the open top portion 24, providing the user with a surface to optimally engage his or her lips for drinking in addition to serving as an engaging mechanism for attachment to the plate 12 as discussed in detail below.

Referring to FIG. 1, the beverage cup 16 slides into the cup receiving structure 18 of the plate 12, at an opening 36, opposite the third side 22. The substantially parallel sides 20 and third side 22 include a flange 37 extending inwardly, forming an inwardly facing channel 38 about a bottom edge opposite the bottom surface 14 sized to accommodate the lip 34 of the cup 16. Holding the cup 16 in a horizontal alignment with the plate 12, a user then positions the lip 34 of the cup 16 in front of the opening 36 at a position below the top surface 13. The substantially parallel edges 28 and third edge 30 of the cup 16 match to the substantially parallel sides 20 and third side 22 of the cup receiving structure 18. The complementary shapes of the cup 16 and cup receiving structure 18 allow for greater contact area between the cup 16 and cup receiving structure 18, which provides greater stability of the assembly 10. Now referring to FIG. 2, when the user first slides the cup 16 into the opening 36, the lip of the cup 34 engages with the inwardly facing channels 38 of the substantially parallel sides 20 and third side 22 to hold it in place. Once the beverage cup 16 is fully engaged within the cup receiving structure 18, the cup and plate assembly 10 can be held with one hand.

Figure 4:
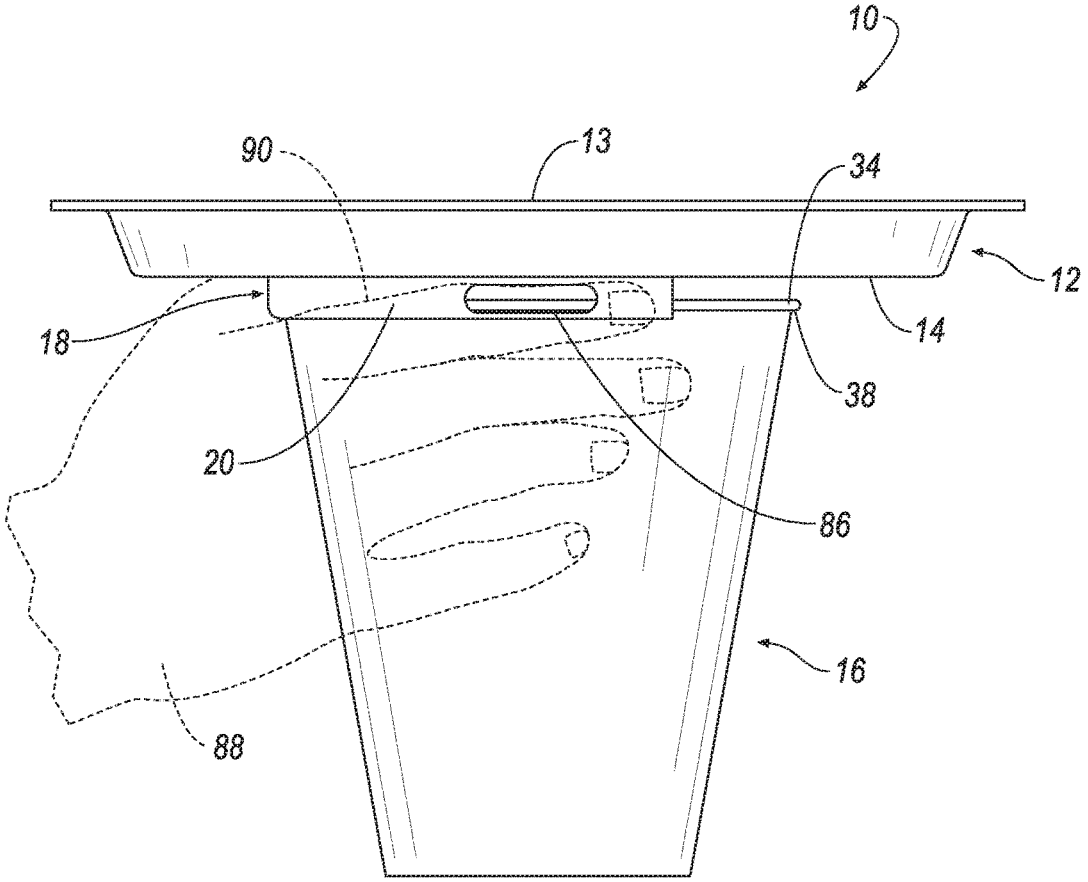
FIG. 4 is a side view of the plate and cup assembly of FIG. 1.

Turning next to FIGS. 3 and 4, the cup 16 is securely attached to the plate 12 such that the user can hold the assembly 10 with just one hand. Further, FIG. 3 shows a cross sectional view of the cup and plate assembly 10, including the plate 12 having a top surface 13 and bottom surface 14. The lip of the cup 34 is securely held in place by the inwardly facing channels 38, of the cup receiving structure 18. The cup receiving structure 18 is integrally molded to the bottom surface of the plate 14.

FIG. 4 is a side view of the plate and cup assembly 10 according to an exemplary embodiment of the present invention. In some embodiments, the substantially parallel side 20 of the cup receiving structure 18 includes a gripper element 86. In the illustrated embodiment, the gripper 86 is an aperture. The gripper 86 is designed such that a user 88 holding both the plate 12 and cup 16 in one hand can have a finger 90 on the lip 34 of the cup 16 through the aperture 86 for security and added balance. Although the aperture 86 illustrated in FIG. 4 is presented on one of the substantially parallel sides 20, it is understood that the location is not limited thereto. For instance, the gripper 86 may be included on one of the remaining sides of the cup receiving structure 18, such as the third side 22.

According to an exemplary embodiment of the present invention, the attachable plate and cup assembly 10 allows the user 88 to hold with one hand both a plate 12 and cup 16. This assembly may be useful across a variety of social settings in which table space is limited. By holding a plate and cup in just one hand, it enables the user to have a free hand in which to use a utensil to eat the food on the plate, hold an additional item, greet guests, or perform a variety of other tasks all while standing.

It should be understood that although an example embodiment has been disclosed, a worker of ordinary skill in this art would recognize that certain modifications would come within the scope of this disclosure. For that reason, the following claims should be studied to determine the true scope and content of this invention.

The invention claimed is:

1. A plate and cup assembly, comprising:

a cup having an open top portion and a closed bottom portion wherein said open top portion has at least two substantially parallel linear edges; and a plate having a top surface, a bottom surface, and cup receiving structure protruding downward from the bottom surface, the cup receiving structure having at least two substantially parallel sides, each side having an inwardly facing channel to accommodate a lip of the cup, wherein the cup receiving structure includes an opening configured to receive the cup, and an aperture on one of the substantially parallel sides or the third side that provides access to the cup through the cup receiving structure.

2. The assembly of claim 1, wherein the cup is configured to slide into the cup receiving structure from one side with the substantially parallel linear edges of the cup sliding into engagement with the substantially parallel sides of the cup receiving structure.

3. The assembly of claim 1, wherein the cup receiving structure has a third side substantially perpendicular to the parallel sides.

4. The assembly of claim 1, wherein the cup receiving structure protrudes perpendicular from the bottom surface of the plate.

5. The assembly of claim 1, wherein the cup includes a rounded edge connecting two of the substantially parallel edges.

6. The assembly of claim 1, wherein each of the substantially parallel sides are the same length.

7. The assembly of claim 1, wherein the top surface of the plate is indented about a perimeter for stacking of multiple plates.

8. A plate, comprising:

a bottom surface; and a unitary cup receiving structure extending from the bottom surface, the structure having at least two substantially parallel sides and a third side connecting the parallel sides forming a U-shape, and an opening on a fourth side configured to receive the cup, and an aperture on one of the substantially parallel sides or the third side that provides access to the cup through the cup receiving structure.

9. The plate of claim 8, wherein the cup receiving structure has an inwardly facing channel about a bottom edge of the substantially parallel sides.

10. The plate of claim 8, wherein the opening is configured to receive a cup.

11. The plate of claim 8, wherein the cup receiving structure is integrally molded with the bottom surface.

* * * * *